US006017041A

United States Patent [19]

Gignoux

[11] Patent Number: 6,017,041

[45] **Date of Patent: *Jan. 25, 2000**

[54] IN-LINE ROLLER SKATE

[75] Inventor: Pierre Gignoux, Coublevie, France

[73] Assignee: Skis Rossignol S.A., Voiron, France

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/959,092

[22] Filed: Oct. 28, 1997

[30] Foreign Application Priority Data

Oct. 30, 1996 [FR] France ..... 96 13480

[51] Int. Cl.[7] ..... A63C 17/02

[52] U.S. Cl. ..... 280/11.22; 280/11.27

[58] Field of Search ..... 280/11.22, 11.19, 280/11.23, 11.27, 7.12, 7.13, 11.28

[56] References Cited

U.S. PATENT DOCUMENTS

| | | | |
|---|---|---|---|
| 2,029,392 | 2/1936 | Ruske | 280/11.23 |
| 2,168,820 | 8/1939 | Edstrom | 280/11.23 |
| 5,135,244 | 8/1992 | Allison . | |
| 5,253,884 | 10/1993 | Landers | 280/11.27 |
| 5,374,072 | 12/1994 | Landers | 280/11.27 |
| 5,503,413 | 4/1996 | Belogour | 280/11.22 |
| 5,513,862 | 5/1996 | Chuang | 280/11.22 |
| 5,775,706 | 7/1998 | Caeran | 280/11.22 |
| 5,775,707 | 7/1998 | Hu et al. | 280/11.22 |
| 5,890,724 | 4/1999 | Gignoux et al. | 280/11.28 |

FOREIGN PATENT DOCUMENTS

| | | |
|---|---|---|
| 8702068 | 9/1987 | Netherlands . |
| 2160780 | 1/1986 | United Kingdom . |

*Primary Examiner*—J. J. Swann
*Assistant Examiner*—David R. Dunn
*Attorney, Agent, or Firm*—Bugnion S.A.; John Moetteli

[57] ABSTRACT

An in-line roller skate is provided which comprises a main chassis (1) having two lateral plates (1a), between which at least two rollers (2, 3, 4, 5) are mounted, and an auxiliary chassis (8) which is of U-shaped profile, which straddles the main chassis and is articulated onto this main chassis. The auxiliary chassis (8) is articulated about two disks (12) which are fixed on the outer faces of the main chassis (1). The disks (12) may have two cylindrical bearing zones (14, 15) of different diameters. The auxiliary chassis (8) has circular cutouts (16), each having diameters corresponding to the diameters of the bearing zones of the disks (12), the smaller diameter (14) being located toward the inside of the auxiliary chassis. This design makes it possible to free the interior of the main chassis for the rollers.

5 Claims, 4 Drawing Sheets

IN-LINE ROLLER SKATE

FIELD OF THE INVENTION

The present invention relates to an in-line roller skate comprising a main chassis having two parallel lateral plates, between which at least two rollers are mounted, and an auxiliary chassis which has a U-shaped profile, straddles the main chassis, is articulated to this main chassis about a pin parallel to the axles of the rollers, and bears a boot.

PRIOR ART

GB Patent 2 160 780 discloses a skate having two in-line rollers mounted at the ends of a main chassis, at the center of which an auxiliary chassis bearing the boot is articulated. A similar skate is also disclosed by U.S. Pat. No. 5,135,244.

The Applicant has further produced an in-line skate having four rollers, of which the auxiliary chassis, which bears the boot, has a U-shaped profile which straddles the main chassis and is articulated onto the latter about a pin located between the front two rollers, or just above the axle of the second roller from the front. A skate of this type is described in Patent Application FR 2.744.033 in the name of the Applicant.

For obvious reasons of weight, the parallel vertical plates of the main chassis, between which the rollers are mounted, is of a limited thickness, these plates, which are generally made of alumina alloy, being stiff enough even when they have a thickness measuring as little as a few millimeters. The auxiliary chassis is articulated onto the main chassis by means of a screw and a tubular nut which passes through the plates of the main chassis and which is long enough to support the main chassis and the auxiliary chassis. There is little space between the rollers and the inner walls of the main chassis, which leaves very little room for the head of the tubular nut. In order to be able to produce the articulation, it is consequently necessary not only to use a nut head which is as short as possible, but also to embed this head partially in the wall of the main chassis. These two measures weaken the articulation.

SUMMARY OF THE INVENTION

The object of the invention is to produce an articulation which is no longer constrained by the inner space available between the rollers and the main chassis.

The design according to the invention is one wherein the auxiliary chassis is articulated about two disks that are fixed on the outer faces of the main chassis.

Not only is there no longer any part protruding inside the main chassis, but the use of a disk makes it possible to increase the bearing surface and consequently reduce the forces on the pivot formed in this way.

In order for them to support the auxiliary chassis laterally as well, the disks preferably have two cylindrical bearing zones of different diameters, and the auxiliary chassis has auxiliary circular cutouts, each having two diameters corresponding respectively to each of the diameters of the bearing zones of the disks, the smaller diameter being located to the inside of the auxiliary chassis. This prevents any spreading of the auxiliary chassis.

According to a preferred embodiment of the invention, the skate has four rollers and the disks are fixed, on the one hand, by a roller nut and, on the other hand, by an auxiliary screw.

By providing a plurality of tapped holes on the main chassis, these holes lying on an arc of a circle which is centered on the axle of the roller whose nuts serve to retain the disks, it is possible to modify the position of the disks either to the front or to the rear, and consequently to modify the position of the articulation of the auxiliary chassis in the longitudinal direction of the skate.

BRIEF DESCRIPTION OF THE DRAWINGS

The appended drawing represents an embodiment of the skate according to the invention by way of example.

DESCRIPTION OF THE PREFERRED EMBODIMENT

Figure 1:
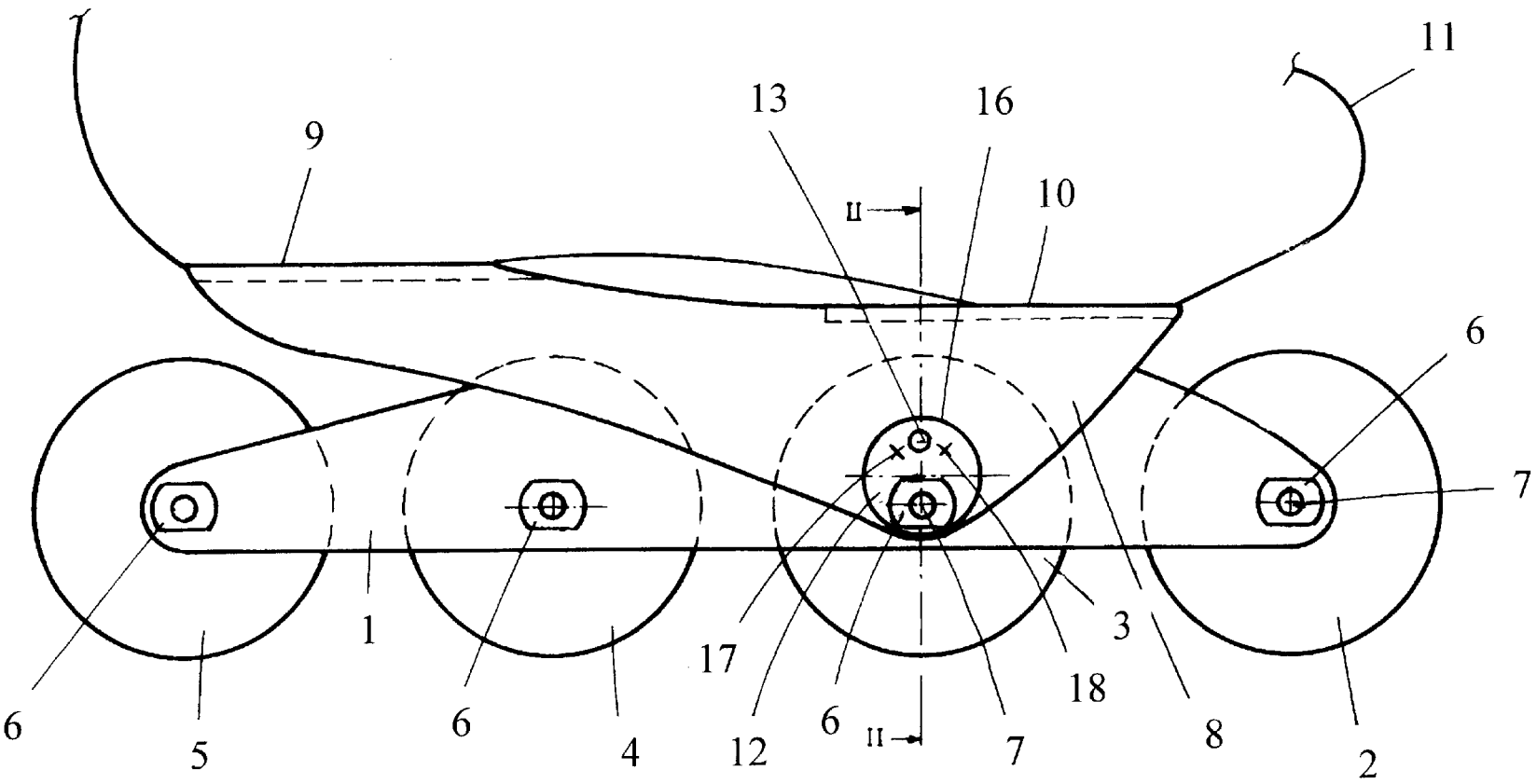
FIG. 1 is a side view of the skate, of which the boot has been partially represented and the rollers have been schematically represented.

The skate which is represented comprises a main chassis 1 bearing four in-line rollers 2, 3, 4, 5, the shafts of which, not capable of rotating, are fixed by means of nuts 6 screwed onto the threaded ends of the shafts 7.

An auxiliary chassis 8, having two platforms 9 and 10 on which a boot 11 is fixed, is mounted on the main chassis 1.

Figure 2A:
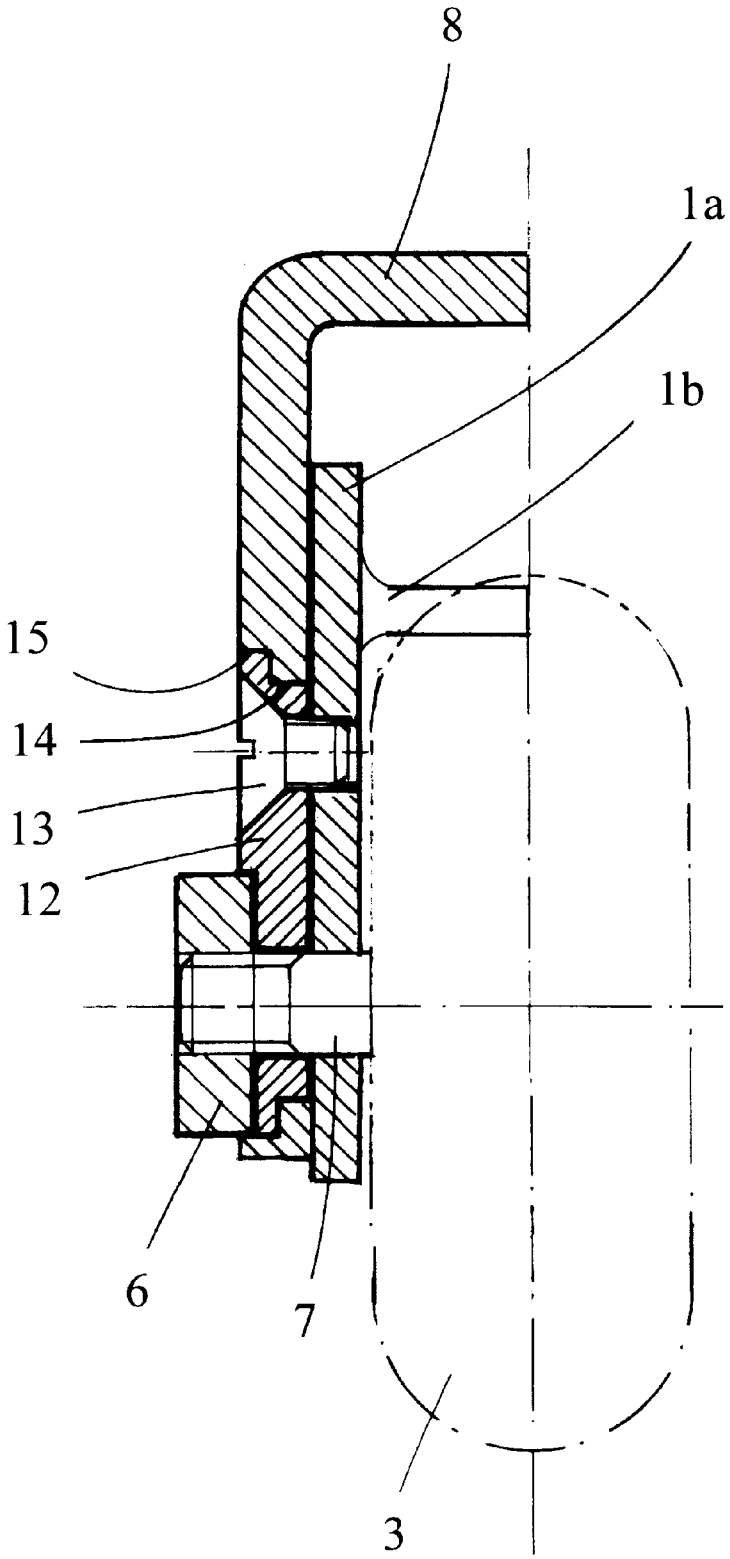
FIG. 2A is a half cross section on II—II in FIG. 1.
Figure 2B:
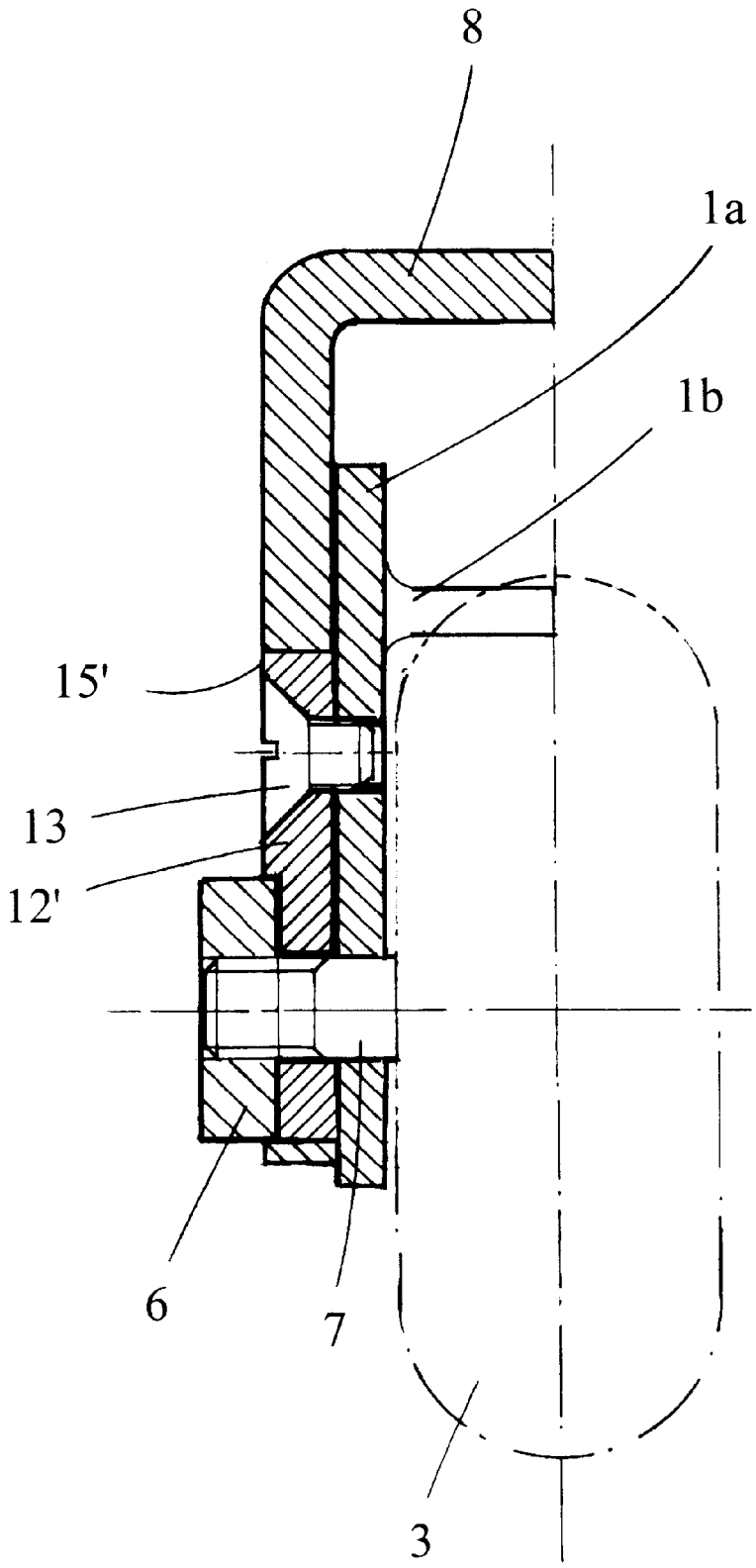
FIG. 2B is a half cross section on II—II in FIG. 1, of an alternate embodiment of the invention.

The main chassis 1, which is monobloc, has two parallel vertical flanges, one la of which can be seen in FIG. 2B. These flanges are joined by struts, for example the strut 1*b* of which a portion can be seen in FIG. 2. At least in the region of the platforms 9 and 10, the auxiliary chassis 8 has a U-shaped profile which straddles the main chassis 1, as can be seen in FIGS. 2A and 2B, and is articulated onto the main chassis 1 about a pin located above the axle of the roller 3, vertically in line with this axle. The articulation is produced by means of disks 12 which have the same thickness as the flanges of the auxiliary chassis 8. These disks 12 are fixed, on the one hand, by the nuts 6 of the shaft 7 of the wheel 3 and, on the other hand, by screws 13 which are screwed into the main chassis 1. The disks 12 have two different diameters, defining two cylindrical bearing zones 14 and 15, the bearing zone 14 of smaller diameter being located on the side adjacent to the main chassis 1. The disks 12 fit into circular cutouts 16 of the flanges of the auxiliary chassis 8, which cutouts have two diameters corresponding respectively to the diameters 14 and 15. The disks 12 therefore serve as pivots defining an axis 20, for the auxiliary chassis 8, while also preventing this chassis from spreading.

It should be noted that it is not necessary that each of the disks 12 be comprised of two diameters, although this is preferred. All that is necessary is a single bearing diameter on each disk 12. In the embodiment described above, the larger diameter 15' defines an optional outer flange. However, as shown in FIG. 2B, an alternate embodiment includes discs 12' which have only one diameter 15' and no flange.

This has the advantage that there is no longer any part protruding inside the main chassis, thus permitting the axis 20 (shown in FIG. 3) to be independent of the axes of the shafts 7 of the rollers 2, 3, 4 and 5. In other words, the axis 20 of the chassis 1 is offset from the shafts 7 of the rollers 2, 3, 4 and 5.

An opportunity for adjustment can be obtained by providing additional holes, for example the holes 17 and 18, in the main chassis. These tapped holes are located on an arc of a circle which is centered on the geometrical axis of the shaft 7 and passes through the center of the hole into which the screw 13 is screwed. This screw 13 can therefore be screwed into the hole 17 or 18, which respectively corresponds to shifting the disks 12, that is to say the auxiliary chassis 8, to the rear and to the front. This provides an opportunity of adjusting the position of the auxiliary chassis relatively to the main chassis and its pivot pin.

The skate is, of course, also equipped with an elastic support at the rear of the articulation 12. This elastic support may, for example, be produced as represented in one or other of the embodiments described in Patent Application FR 96 01242.

Figure 3:
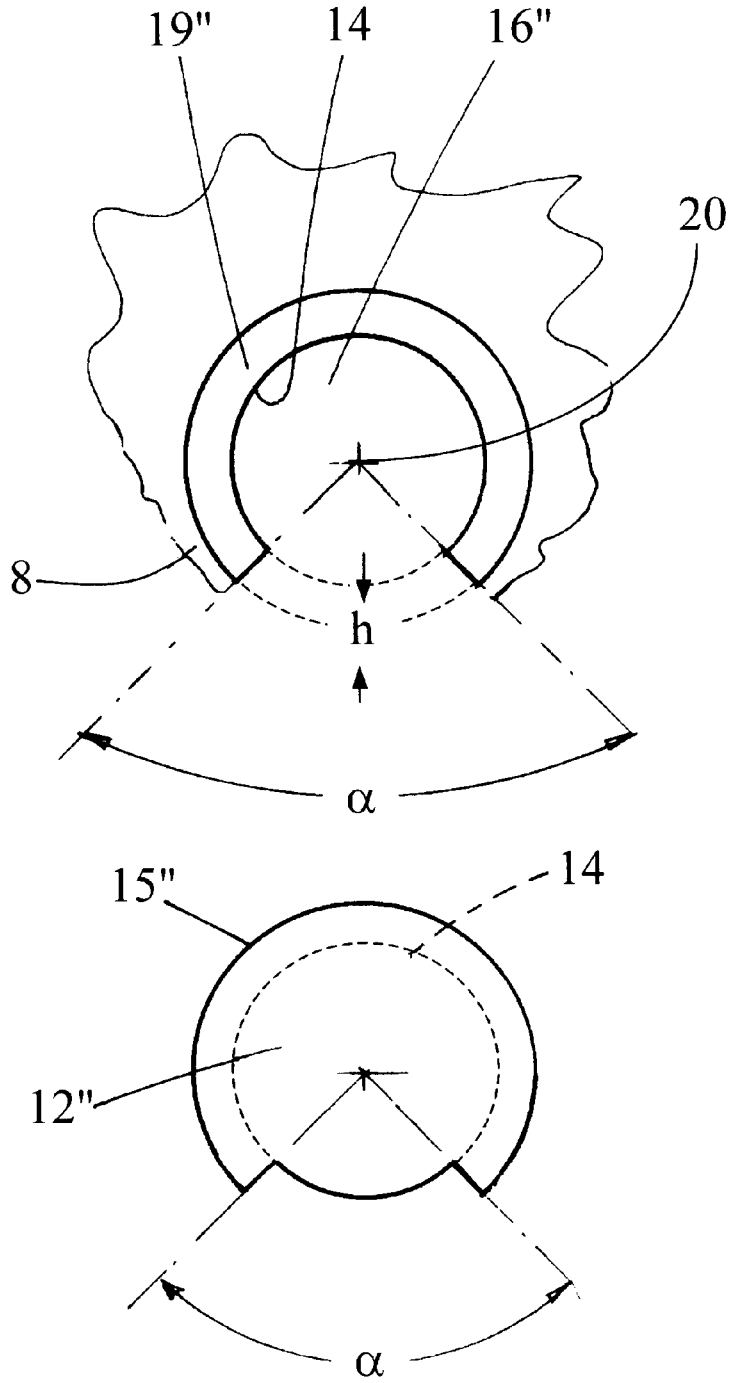
FIG. 3 represents an alternative embodiment.

In order to increase the strength of the auxiliary chassis 8 to withstand the vertical thrust in the part lying below the circular cutouts 16, without increasing the height of the auxiliary chassis at this point, since a downward extension may be a hindrance during skating, a recessed annular flat formed in the cutouts 16 by its two different diameters may be limited to a is restricted angular range. An embodiment of this type is represented in FIG. 3. The outer circumference is interrupted over an angle $\alpha$ in the lower region of a cutout 16". The same is therefore true for a flat 19" formed by the two diameters, and for the outer cylindrical bearing zone 15" of modified disks 12". The full thickness of the auxiliary chassis 8 is thus reduced by h, the difference between the inner edge of the cutout 16 and the lower edge of the auxiliary chassis 8 of embodiments previously described.

I claim:

1. An in-line roller skate comprising a main chassis (1) having two parallel lateral plates **(1*a*), between which at least two rollers (2, 3, 4, 5) are mounted, and an auxiliary chassis (8) which has a U-shaped profile, which straddles the main chassis and is pivotally connected to this main chassis about an axis (20), characterized in that the axis is defined by two disks (12), each disk being fixed on an outer face of the main chassis (1) and each disk having at least one cylindrical bearing zone (14, 15); in that the auxiliary chassis has at least one corresponding circular cutout (16), having a cylindrical surface which is in bearing contact with the at least one bearing zone of each disk; and in that the axis of the chassis is offset from all shafts (7) of the at least two rollers (2, 3, 4, 5)**.

2. The roller skate as claimed in claim 1, wherein the disks (12) have two cylindrical bearing zones (14, 15) of different diameters, the larger diameter defining an outer flange, and wherein the auxiliary chassis (8) has circular cutouts (16), each having two diameters corresponding to each of the diameters of the bearing zones of the disks (12), the smaller diameter (14) being located to the inside of the auxiliary chassis.

3. The roller skate as claimed in claim 1, wherein the cylindrical bearing zones (15') of larger diameter and flats (19) of corresponding diameter in the circular cutouts (16') are interrupted over a certain angle ($\alpha$) in their lower region.

4. The roller skate as claimed in claim 1, wherein the roller axles of which are equipped with fasteners (6, 13), whereby the disks (12) are fixed, on one end, by a roller nut (6) and, on another end, by an auxiliary screw (13).

5. The roller skate as claimed in claim 3, wherein the main chassis (1) has, on each side, at least one second, threaded hole (17, 18) which can accommodate the auxiliary fastening screw (13) of the corresponding disk, this second hole being located on an arc of a circle that is centered on the axis of the roller nut and passes through the axis of the screw (13).

* * * * *